US005918688A

United States Patent [19]

Evans

[11] Patent Number: 5,918,688

[45] Date of Patent: Jul. 6, 1999

[54] GAS-FILLED ACCELERATOR

[75] Inventor: Robert W. Evans, Montgomery, Tex.

[73] Assignee: Dailey International, Inc.

[21] Appl. No.: 08/947,622

[22] Filed: Oct. 9, 1997

[51] Int. Cl.[6] ..... E21B 31/107

[52] U.S. Cl. ..... 175/57; 166/178; 175/296; 175/321

[58] Field of Search ..... 175/321, 296, 175/57; 166/178, 378

[56] References Cited

U.S. PATENT DOCUMENTS

| | | | |
|---|---|---|---|
| 1,529,409 | 3/1925 | Condra . | |
| 3,221,826 | 12/1965 | Webb | 175/297 |
| 3,642,069 | 2/1972 | Adkins | 166/301 |
| 3,724,576 | 4/1973 | Roberts | 175/293 |
| 3,735,828 | 5/1973 | Berryman | 175/299 |
| 3,815,693 | 6/1974 | Sutliff et al. | 175/232 |
| 3,834,472 | 9/1974 | Perkins | 166/178 |
| 4,200,158 | 4/1980 | Perkins | 175/297 |
| 4,846,273 | 7/1989 | Anderson et al. | 166/178 |
| 5,139,086 | 8/1992 | Griffith, Sr. | 166/178 |
| 5,156,211 | 10/1992 | Wyatt | 166/301 |
| 5,425,430 | 6/1995 | Roberts | 175/296 |
| 5,431,221 | 7/1995 | Roberts et al. | 166/73 |
| 5,447,196 | 9/1995 | Roberts | 166/178 |
| 5,503,228 | 4/1996 | Anderson | 166/301 |
| 5,584,353 | 12/1996 | Chancey et al. | 175/297 |
| 5,791,420 | 8/1998 | Budney | 175/296 |

*Primary Examiner*—Hoang C. Dang
*Attorney, Agent, or Firm*—Arnold White & Durkee

[57] ABSTRACT

An accelerator having a tubular housing and a tubular mandrel substantially coaxial arranged for telescoping longitudinal movement within the tubular housing, the accelerator also including: a first piston positioned radially between the tubular housing and mandrel, the first piston being adapted for movement with the mandrel in response to movement of the mandrel in a first longitudinal direction relative to the housing and adapted to resist longitudinal movement in response to movement of the mandrel in a second longitudinal direction relative to the housing; and a second piston positioned radially between the tubular housing and mandrel, the first and second pistons forming a substantially sealed gas chamber therebetween, the second piston being adapted for movement with the mandrel in the second longitudinal direction relative to the housing and adapted to resist longitudinal movement in response to movement of the mandrel in the first longitudinal direction relative to the housing, and whereby the chamber has an increase in pressure in response to movement of the mandrel in both the first and second longitudinal directions relative to the housing until released by a jar mechanism, said accelerator also having fluid reservoirs formed between said tubular housing and mandrel and adapted for receiving an operating fluid therein, said reservoirs adapted for providing said operating fluid adjacent to said first and second pistons opposite said gas chamber, said first and second pistons having at least one seal to separate said gas chamber from said reservoirs.

21 Claims, 4 Drawing Sheets

GAS-FILLED ACCELERATOR

BACKGROUND OF THE INVENTION

1. Technical Field

This invention relates to an accelerator for use with hydraulic jars in a drilling environment and, in particular, to a gas-filled accelerator for use with double acting hydraulic jars.

2. Description of the Related Art

Drilling jars have long been known in the field of well drilling equipment. A drilling jar is a tool employed when either drilling or production equipment has become stuck to such a degree that it cannot be readily dislodged from the wellbore. The drilling jar is normally placed in the drill string in the region of the stuck object and allows an operator at the surface to deliver a series of impact blows to the drill string via a manipulation of the drill string, such as by lowering and raising the drill string. Hopefully, these impact blows to the drill string are sufficient to dislodge the stuck object and permit continued operation.

Drilling jars contain a sliding joint which allows relative axial movement between an inner mandrel and an outer housing without allowing rotational movement therebetween. The mandrel typically has a hammer formed thereon, while the housing includes an anvil positioned adjacent the mandrel hammer. Thus, by sliding the hammer and anvil together at high velocity, they transmit a very substantial impact to the stuck drill string, which is often sufficient to jar the drill string free.

In some instances it is desirable to greatly enhance the force of the impact blows so that a much larger hammering force can be applied to a stuck object. Typically, the force of the drilling jar has been enhanced by adding an accelerator to the drill string. The accelerator is used to store energy until the jar is triggered. When the jar is triggered, the accelerator quickly releases its stored energy and accelerates the hammer of the drilling jar to a very high speed. The force of the impact is, of course, related to the square of the velocity, thus, the hammer force is greatly enhanced by the accelerator.

Drilling jars have been developed that are capable of delivering hammer blows in both an upward and downward direction. For example, U.S. Pat. No. 4,361,195, issued Nov. 30, 1982, to Robert W. Evans, describes such a double acting drilling jar. Double acting accelerators have also been developed, such as that described in U.S. Pat. No. 5,232,060 issued Aug. 3, 1993 to Robert W. Evans.

SUMMARY OF THE INVENTION

The present invention provides an improved gas-filled accelerator and method of operation for filling and discharging the gas chamber of the accelerator. The accelerator includes a tubular housing, and a tubular mandrel substantially coaxial arranged for telescoping longitudinal movement within the tubular housing. A first piston is positioned radially between the tubular housing and mandrel, and is adapted to movement with the mandrel in response to movement of the mandrel in a first longitudinal direction relative to the housing. Further, the first piston is also adapted to resist longitudinal movement in response to movement of the mandrel in a second longitudinal direction relative to the housing. A second piston is positioned radially between the tubular housing and mandrel, and with the first piston forms a substantially sealed compressible gas chamber therebetween. The second piston is adapted for movement with the mandrel in response to movement of the mandrel in the second longitudinal direction relative to the housing and adapted to resist longitudinal movement in response to movement of the mandrel in the first longitudinal direction relative to the housing. Thus, the gas in the chamber has an increase in pressure in response to movement of the mandrel in both the first and second longitudinal directions relative to the housing.

The gas chamber of the present invention is a closed system contained within at least two pistons. A lubricating fluid or oil of the accelerator chamber surrounds the gas chamber. The gas and lubricating fluid combination provides for a less abrasive environment for the gas chamber seals than the gas/drilling mud arrangement of prior art accelerators.

Another advantage of the present invention is a built-in compensating system. The system consists of a pressure relief valve, or similar device, that allows a small amount of the lubricating oil to flow from the oil chamber into the gas chamber when the lubricating oil pressure exceeds the pressure in the gas chamber. The transfer of lubricating oil to the gas chamber occurs in order to equalize the differential pressures resulting from temperature increases in the well borehole. The ability of oil to flow through the pressure relief valve into the gas chamber prevents deformation of the housings and failure of seals in the downhole assembly.

The present invention also allows for easier and safer filling and discharging of gas into and out of the gas chamber. The present invention has seals (such as O-rings), an external plug and external valve assembly which allows the operator to safely fill the gas chamber. In the present invention, the operator is able to seal the gas chamber and then safely bleed, or empty, any trapped gas in the filling lines. Discharging of the gas is safely accomplished by reversing the procedure and venting the pressure in the gas to chamber completely before disassembling the downhole tool.

BRIEF DESCRIPTION OF THE DRAWINGS

Other objects and advantages of the invention will become apparent upon reading the following detailed description and upon reference to the drawings in which.

Figure 1A:
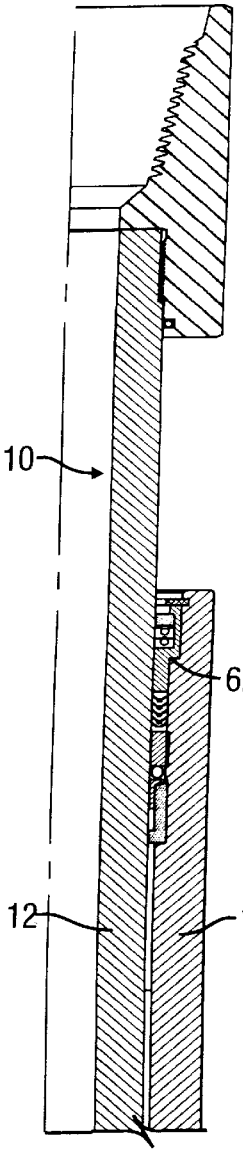
FIGS. 1A–D illustrate successive portions, in quarter section, of a gas-filled accelerator in its filling and discharging position.

While the invention is susceptible to various modifications and alternative forms, specific embodiments thereof have been shown by way of example in the drawings and will herein be described in detail. It should be understood, however, that this specification is not intended to limit the invention to the particular forms disclosed herein, but on the contrary, the intention is to cover all modifications, equivalents, and alternatives falling within the spirit and scope of the invention, as defined by the appended claims.

DESCRIPTION OF ILLUSTRATIVE EMBODIMENTS

Figure 1B:
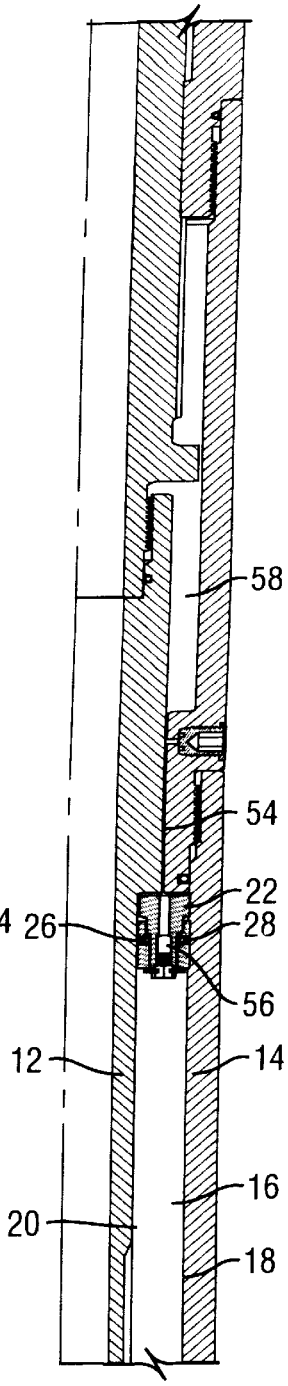
Figure 1C:
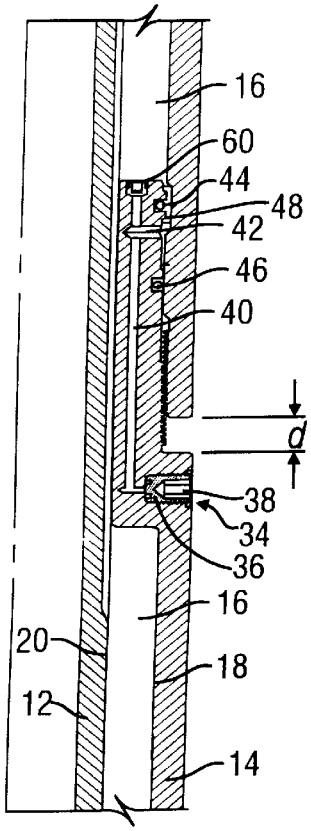
Figure 1D:
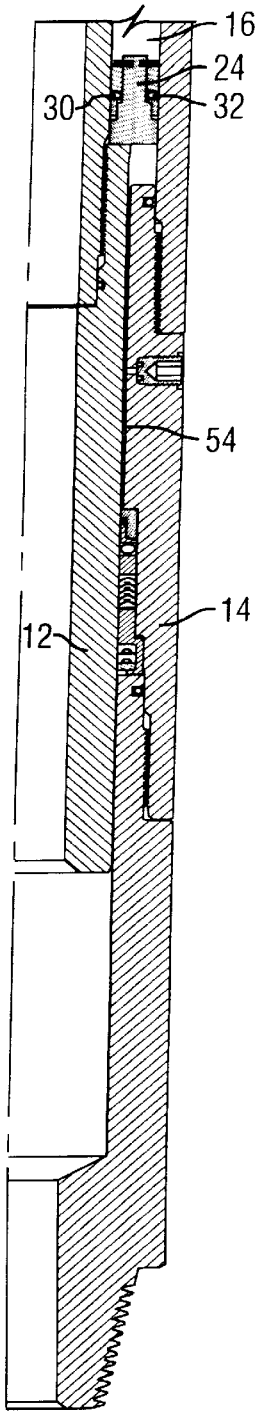

Referring to the drawings, and in particular, to FIGS. 1A–D, inclusive, there is shown a gas-filled accelerator 10, which is of substantial length necessitating that it be shown in four longitudinally broken quarter sectional views, viz. FIGS. 1A, 1B, 1C and 1D. Each of these views is shown in longitudinal section. The accelerator 10 generally comprises an inner tubular mandrel 12 telescopingly supported inside an outer tubular housing 14. The mandrel 12 and housing 14 each consists of a plurality of tubular segments joined together preferably by threaded interconnections.

Mandrel 12 and housing 14 are formed in sections for purposes of assembly. Mandrel 12 is arranged for sliding movement inside housing 14. A substantially sealed chamber 16, formed between the mandrel 12 and housing 14, is filled with a suitable compressible gas, such as nitrogen. A first substantially sealed reservoir 58 is formed between mandrel 12 and housing 14 and contains a lubricating oil. A second substantially sealed reservoir 54 is also formed between mandrel 12 and housing 14 and also contains a lubricating oil. It is therefore necessary to provide seals against leakage from threaded joints formed at the various sections of the mandrel 12 and housing 14 and also from the points of sliding engagement between the mandrel 12 and housing 14. It is also necessary to provide seals between chambers 16, 54 and 58 to direct the fluid flow between the chambers through pressure relief valves.

Gas chamber 16 is more particularly formed between the spaced apart inner surface 18 of the housing member 14 and an outer surface 20 of inner mandrel 12. Gas chamber 16 is the main operating chamber. Generally, the gas within chamber 16 resists relative movement of the mandrel 12 and housing 14. That is, relative movement of the mandrel 12 and housing 14 reduces the volume of the chamber 11), causing a significant increase in the internal pressure of the gas within chamber 16, thereby producing a force to resist this relative movement. This resistance to relative movement allows a large buildup of static energy. Thus, when the force urging housing 14 is suddenly removed, as by triggering of the associated drilling jar, the static energy is converted to kinetic energy, causing mandrel 12 and housing 14 to move rapidly and accelerate a hammer within the associated drilling jar (not shown) to strike an anvil surface with great force. It should be appreciated that this buildup of static energy is accomplished by movement of the mandrel 12 relative to the housing 14 in either longitudinal direction.

Means are provided for substantially sealing chamber 16 to permit the buildup of pressure therein. The surfaces 18, 20 of the chamber 16 arc smooth cylindrical surfaces, permitting free movement of a pair of pressure pistons 22 and 24 supported therebetween and defining chamber 16. At the upper end of gas chamber 16, an annular pressure piston 22 is positioned between the surfaces 18, 20 for sliding movement therebetween. Piston 22 is sealed against fluid leakage by O-rings 26, 28. At the lower end of gas chamber 16, annular pressure piston 24 is positioned between the surfaces 18, 20 for sliding movement therebetween. Piston 24 is sealed against fluid leakage by O-rings 30, 32.

Figure 2A:
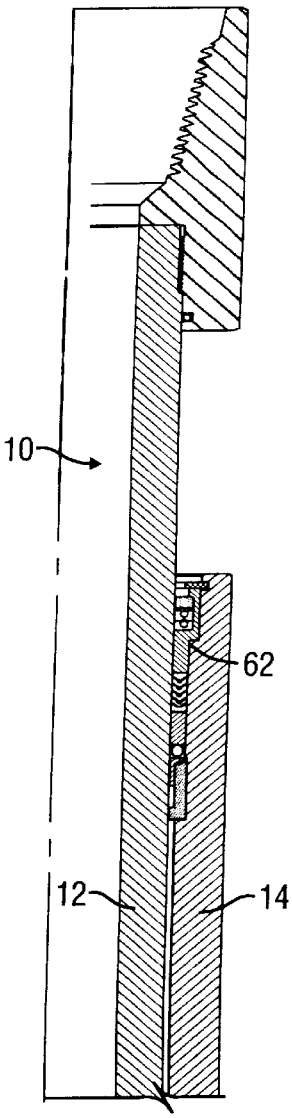
FIGS. 2A–D illustrate successive portions, in quarter section, of the gas-filled accelerator of FIG. 1 in its neutral operating position.
Figure 2B:
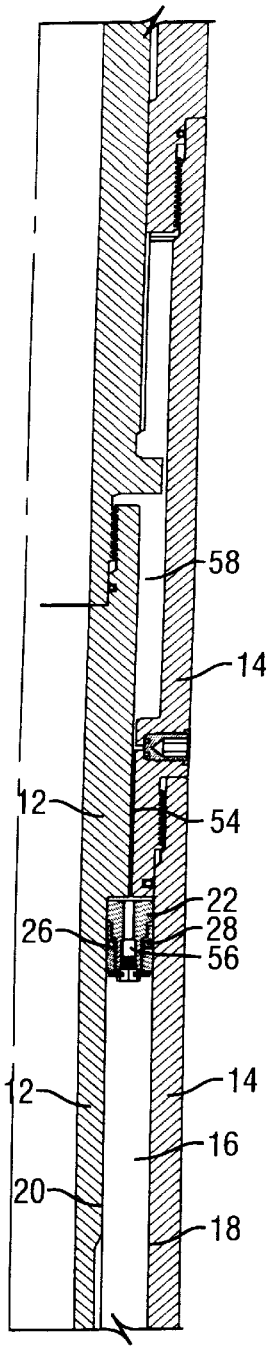
Figure 2C:
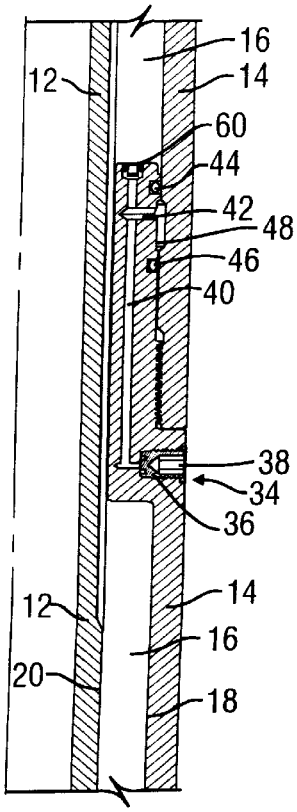
Figure 2D:
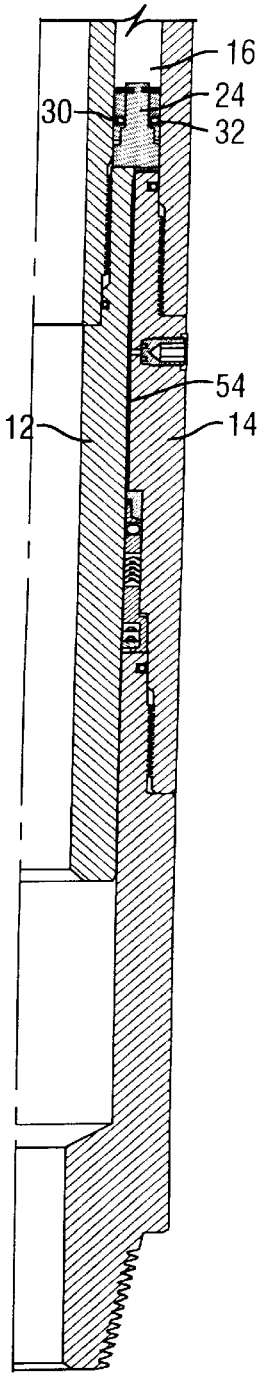

FIG. 1 shows the preferred embodiment accelerator 10 in a position to charge chamber 16 with gas. The accelerator 10 has an external plug assembly 34 disposed on outer housing 14. The external plug assembly 34 includes a filling port 36 and a filler plug 38. Accelerator 10 also includes a fill hole 40 that operatively connects filler port 36 to end cap 42. The upper end of fill hole 40 is sealed with a fluid plug 60. End cap 42 abuts the interior surface 18 of outer housing 14. An upper seal 44 and a lower seal 46, preferably O-ring seals, prevent the flow of gas from fill hole 40 to chamber 16 when accelerator 10 is in a neutral position (FIG. 2).

To charge accelerator 10 with gas, the outer housing 14 is partially unthreaded for distance d proximate the external plug assembly 34. The partial unthreading of outer housing 14 causes upper seal 44 to align with an open path, preferably an undercut 48 as shown in FIG. 1. The alignment of upper seal 44 with undercut 48 allows for an open flow path of gas from fill tube 40 to chamber 16. The filler plug 38 is then removed from the external plug assembly 34. A standard external filling adapter (not shown) and valve (not shown) is then attached to filler port 36. The operator may then charge chamber 16 with an external source of gas, preferably nitrogen, to a predetermined pressure. As shown in FIG. 1, the partial unthreading of outer housing 14 allows gas to travel from an external source, into port 34, through fill hole 40 and end cap 42 into chamber 16. Once chamber 16 is charged to the proper pressure, the operator then closes the external valve and threads the outer housing 14 together, thereby causing seals 44 and 46 to shut off the passage of gas to chamber 16. The operator then re-opens the external valve to allow residual gas trapped in end cap 42, fill hole 40 and filler port 36 to escape in the atmosphere. The operator then removes the external filling adapter and valve and re-installs filler plug 38 into opening 36 thereby closing fill hole 40. Chambers 54 and 58 are filled with a lubricating fluid (e.g., a lubricating oil) through external plug assemblies 34. At this point, accelerator 10 is fully "armed" and prepared to accelerate the hammer of the jar in response to the jar being triggered.

The discharging of gas from chamber 16 is accomplished by generally performing the above steps in reverse order. After the accelerator completes its intended operation, it is raised out of the wellbore to the surface. Filler plug 38 is when removed, thereby opening fill hole 40. An external filling adapter (not shown) and valve (not shown) are attached to external plug assembly 34. The external valve is securely closed. The operator then partially unthreads outer housing 14 to a distance d causing seals 44 and 46 to open a passage from chamber 16 to fill hole 40. As discussed above, the partial unthreading of outer housing 14 causes upper seal 44 to align with undercut 48, thereby allowing for an open flow path of gas from chamber 16 to fill tube 40. The operator then opens the external valve and allows gas to safely discharge from gas chamber 16, end cap 42, fill hole 40 and filler port 36 to the atmosphere or other external container.

Figure 3A:
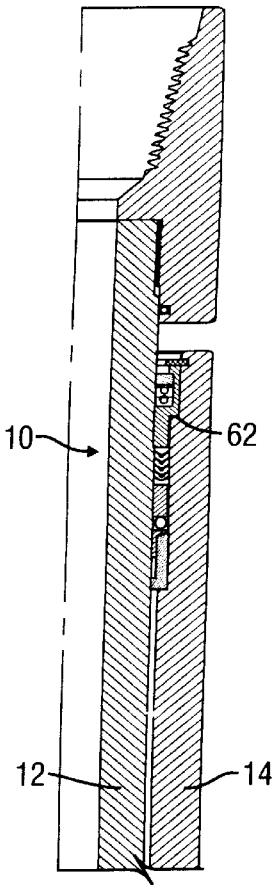
FIGS. 3A–D illustrate successive portions, in quarter section, of the gas-filled accelerator of FIG. 1 in its downstroke or closed operating position.
Figure 3B:
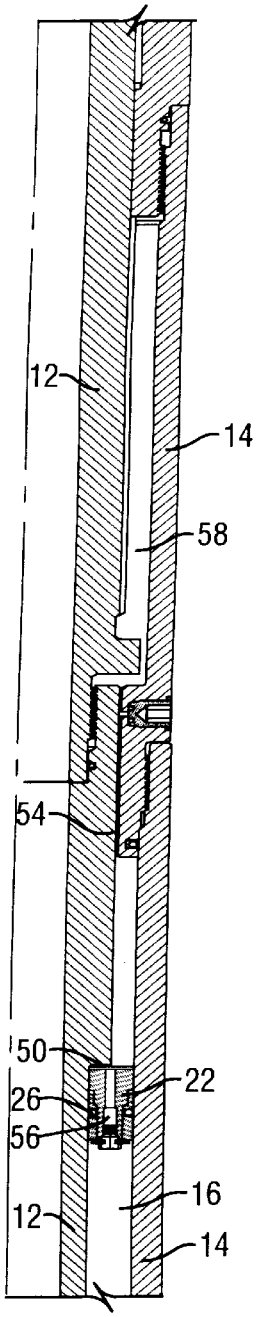
Figure 3C:
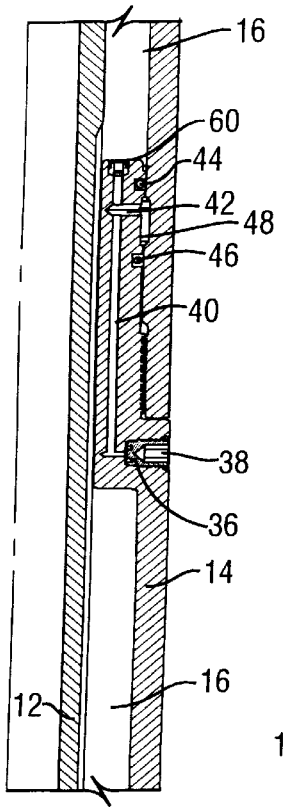
Figure 3D:
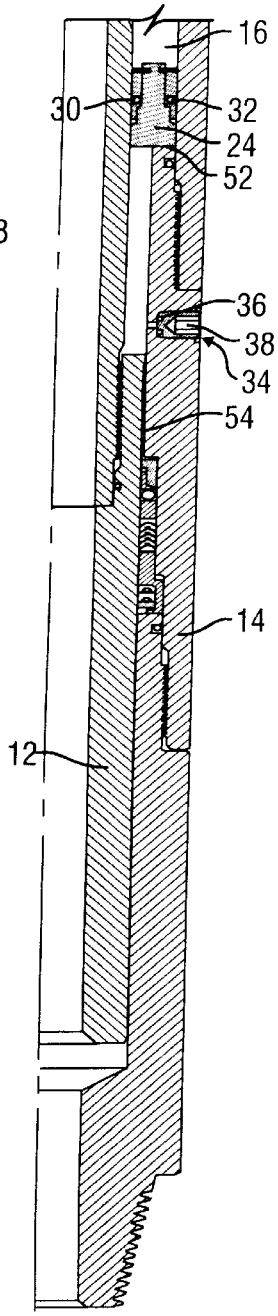
Figure 4A:
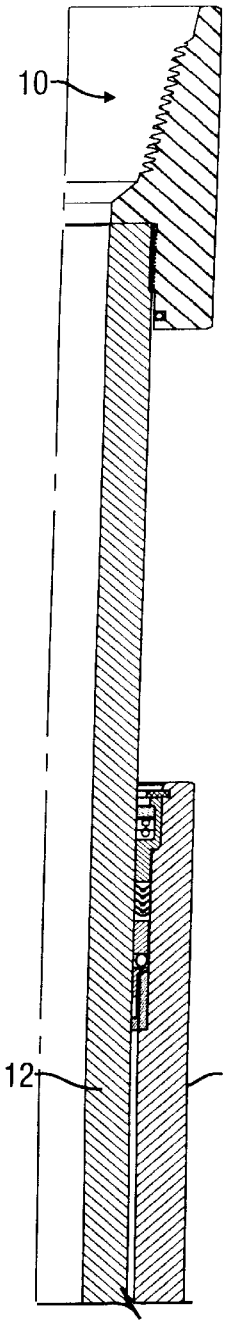
FIGS. 4A–D illustrate successive portions, in quarter section, of the gas-filled accelerator of FIG. 1 in its upstroke or open operating position.
Figure 4B:
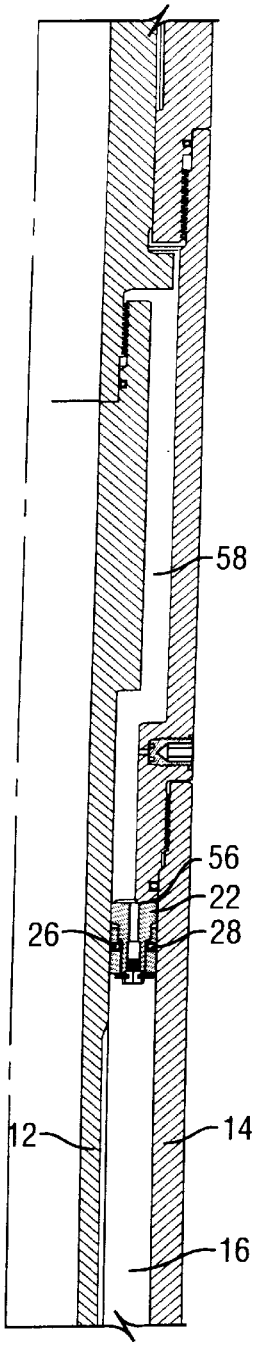
Figure 4C:
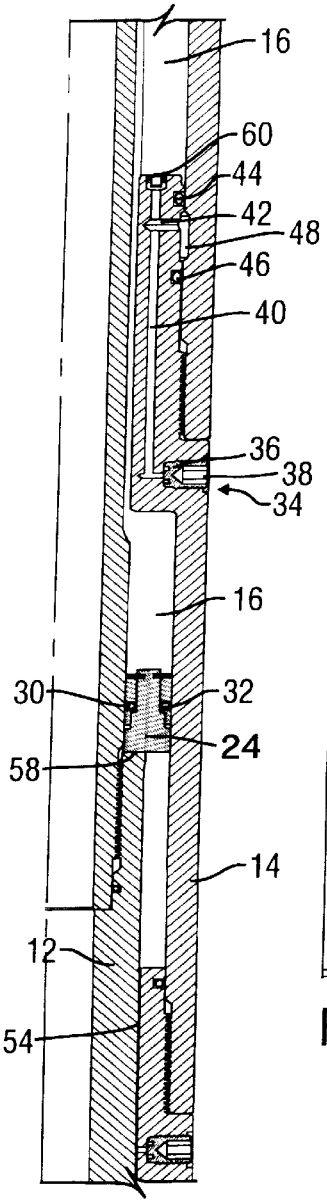
Figure 4D:
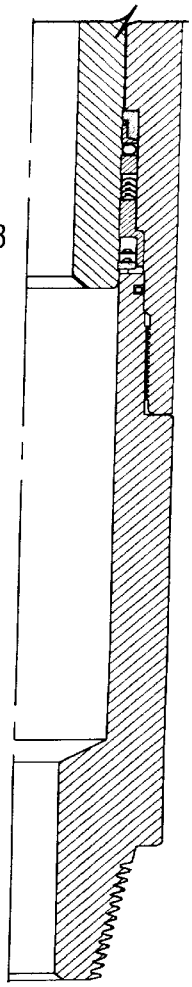

The operation of accelerator 10 is best illustrated in FIGS. 3 and 4. In the downward, or compression mode (FIG. 3), inner mandrel 12 translates downward relative to outer housing 14. Thus, shoulder 50 of inner mandrel 12 engages upper piston 22 and translates it downward. As shown in FIG. 3, lower piston 24 rests on shoulder 52 of outer housing 14 and, thus, remains stationary. Therefore, downward translation of upper piston 22 reduces the volume of chamber 16 causing the pressure therein to increase. This increase in pressure in chamber 16 results in stored potential energy. When the force resisting housing 14 is suddenly removed, as by tripping of the associated drilling jar, the stored potential energy is converted to kinetic energy, causing housing 14 to move rapidly downward and accelerate a hammer within the associated drilling jar (not shown) to strike an anvil surface with great force.

Conversely, if an upward, or tensile force is applied to the drill string (FIG. 4), the inner mandrel 12 will translate upward relative to outer housing 14. As shown in FIG. 4, as inner mandrel 12 translates upward, the shoulder 80 of inner mandrel 12 will engage lower piston 24 and translate it upwards. Upper piston 22 will, in turn, rest on shoulder 56 of outer housing 14 and will, therefore, remain stationary. Therefore, upward translation of lower piston 24 reduces the volume of chamber 16 causing the pressure therein to increase. This increase in pressure in chamber 16 results in stored potential energy. As described above in the downward direction, when the force resisting housing 14 is suddenly removed, such as by the tripping of the associated drilling jar, the stored potential energy is converted to kinetic energy, causing housing 14 to move rapidly upward and accelerate a hammer within the associated drilling jar (slot shown) to strike an anvil surface with great force.

In other words, in either the downward movement (FIG. 3), or the upward movement (FIG. 4), the triggering of a drilling jar (not shown) in the bottomhole assembly will allow free longitudinal movement of outer housing 14 relative to inner mandrel 12. This, in turn, allows the highly pressurized gas in chamber 16 to rapidly return accelerator 10 to its neutral position (as shown in FIG. 2) and release the stored potential energy. The release of the stored potential energy enhances the acceleration force to the drilling jar.

The preferred embodiment of the present invention is an accelerator 10 having an oil lubricant, or similar type of lubricant fluid in the reservoirs 54 and 58. The lubricating fluid of reservoir 58 is contained between inner mandrel 12 and outer housing 14, and is adjacent to piston 22 and is sealed against drilling mud by assembly 62. Thus, the lubricating fluid of reservoir 58 is adjacent to and lubricates seals 26 and 28 of piston 22 and upper seal assembly 62. Therefore, seals 26 and 28 separate the gas of chamber 16 from the lubricating fluid of reservoir 58. Thus, upper seal assembly 62 is a mud/oil interface and, as a result, will have a longer active life due to the lubricating nature of the oil on the seal versus the dry nature of the gas. The gas/lubricating oil interface of seals 26 and 28 of piston 22 will have a longer active life due to the lubricating and cooling properties of the lubricating oil. It will be appreciated that the present invention increases the life of the slinger by removing the mud interface from being adjacent to gas chamber 16.

The reservoirs 58 and 54 are filled with an appropriate lubricating oil. If the temperature of this oil is increased without allowing the associated volume to increase proportionately, an increase in pressure will result which could result in damage to the housings or seals of the slinger. Alternately, the increase in volume can be "bled out" of the reservoir to achieve the same result. The design of the slinger allows for automatic pressure compensation in one or both reservoirs 58 and 54. This is accomplished by placing a pressure relief valve 56 in piston 22 for reservoir 58 or piston 24 for reservoir 54. As the temperature of the slinger is increased by lowering the pipe into the well bore the temperature of the oil in reservoirs 58 and 54 and the gas in chamber 16 will increase correspondingly. However, the resulting pressure increase will be much greater in the oil reservoirs 58 and 54 due to the much greater bulk modulus of oil than gas. As the pressure differential between the gas chamber and oil reservoirs increases, it will exceed in the cracking pressure of the pressure relief valve (for instance 500 psi). The relief valve will open and a small amount of oil will be released into the gas chamber 16. This will reduce the pressure in the oil reservoir to that in the gas chamber. It is important to note that the small amount of oil introduced into the gas chamber will not significantly change the operating characteristics of the slinger.

It should also be noted that chambers 58 and 54 can be configured to be in fluid communication as taught in U.S. Pat. No. 5,232,060 to Evans. Such a configuration would result in the pressure compensation being accomplished with a pressure relief valve in only one piston.

Although a particular detailed embodiment of the apparatus has been described herein, it should be understood that the invention is not restricted to the details of the preferred embodiment, and many changes in design, configuration, and dimensions are possible without departing from the spirit and scope of the invention.

What is claimed is:

1. An accelerator, comprising:

a tubular housing;

a tubular mandrel substantially coaxial arranged for telescoping longitudinal movement within said tubular housing;

a first piston positioned radially between said tubular housing and mandrel, said first piston being adapted for movement with said mandrel in response to movement of said mandrel in a first longitudinal direction relative to said housing and adapted to resist longitudinal movement in response to movement of said mandrel in a second longitudinal direction relative to said housing;

a second piston positioned radially between said tubular housing and mandrel, said first and second pistons forming a substantially sealed gas chamber therebetween, said second piston being adapted for movement with said mandrel in the second longitudinal direction relative to said housing and adapted to resist longitudinal movement in response to movement of said mandrel in the first longitudinal direction relative to said housing, and whereby said gas chamber has an increase in pressure in response to movement of said mandrel in both said first and second longitudinal directions relative to said housing until released by a jar mechanism; and a first and second reservoir between said tubular housing and mandrel adapted to receive a lubricating fluid, said reservoir provides said lubricating fluid adjacent to said first and second pistons on sides of said pistons opposite of said gas chamber.

2. The accelerator of claim 1 wherein said first and second pistons define a restricted passage extending therethrough in fluid communication with said chamber and said reservoirs.

3. The accelerator of claim 1 wherein said first and second pistons define a passage extending therethrough in fluid communication with said chamber and said reservoirs, and one-way pressure relief valves positioned in said passages and adapted to permit fluid communication in a first direction of flow extending from said reservoirs into said chamber.

4. The accelerator of claim 1 wherein said mandrel includes a first shoulder formed thereon and adapted for engaging said first piston in response to movement of said mandrel in said first longitudinal direction relative to said housing, and said housing includes a first shoulder formed thereon and adapted for engaging said second piston to resist longitudinal movement of said second piston in response to movement of said mandrel in said first longitudinal direction relative to said housing.

5. The accelerator of claim 1 wherein said mandrel includes a second shoulder formed thereon and adapted for engaging said second piston in response to movement of said mandrel in said second longitudinal direction relative to said housing, and said housing includes a second shoulder formed thereon and adapted for engaging said first piston to resist longitudinal movement of said first piston in response to movement of said mandrel in said second longitudinal direction relative to said housing.

6. An accelerator comprising:

a tubular housing;

a tubular mandrel substantially coaxial arranged for telescoping longitudinal movement within said tubular housing;

a first piston positioned radially between said tubular housing and mandrel, said first piston being adapted for movement with said mandrel in response to movement of said mandrel in a first longitudinal direction relative to said housing and adapted to resist longitudinal movement in response to movement of said mandrel in a second longitudinal direction relative to said housing;

a second piston positioned radially between said tubular housing and mandrel, said first and second pistons forming a substantially scaled gas chamber therebetween, said second piston being adapted for movement with said mandrel in response to movement of said mandrel in the second longitudinal directions relative to said housing and adapted to resist longitudinal movement in response to movement of said mandrel in the first longitudinal direction relative to said housing, whereby said gas chamber has an increase in pressure in response to movement of said mandrel in both said first and second longitudinal directions relative to said housing;

a fluid reservoir formed between said tubular housing and mandrel and adapted for receiving an operating fluid therein, said reservoir adapted for providing said operating fluid adjacent to said first and second pistons opposite said gas chamber, said first and second pistons having at least one seal to separate said gas chamber from said reservoir.

7. The accelerator of claim 6 wherein said second piston defines a passage extending therethrough in fluid communication with said chamber and said reservoir, and a one-way pressure relief valve positioned in said second piston passage and adapted to permit fluid communication in a first direction of flow extending from said reservoir into said chamber.

8. The accelerator of claim 6 wherein said mandrel includes a first shoulder formed thereon and adapted for engaging said first piston in response to movement of said mandrel in said first longitudinal direction relative to said housing, and said housing includes a first shoulder formed thereon and adapted for engaging said second piston to resist longitudinal movement of said second piston in response to movement of said mandrel in said first longitudinal direction relative to said housing.

9. The accelerator set forth in claim 8 wherein said mandrel includes a second shoulder formed thereon and adapted for engaging said second piston in response to movement of said mandrel in said second longitudinal direction relative to said housing, and said housing includes a second shoulder formed thereon and adapted for engaging said first piston to resist longitudinal movement of said first piston in response to movement of said mandrel in said second longitudinal direction relative to said housing.

10. An accelerator comprising:

a tubular housing;

a tubular mandrel substantially coaxial arranged for telescoping longitudinal movement within said tubular housing in first and second longitudinal directions;

a first piston positioned radially between said tubular housing and mandrel; and a second piston positioned radially between said tubular housing and mandrel, said first and second pistons forming a substantially sealed gas chamber therebetween;

a first shoulder formed on said mandrel and adapted for engaging and moving therewith said first piston in response to movement of said mandrel in said first longitudinal direction relative to said housing;

a first shoulder formed on said housing and adapted for engaging said second piston to resist longitudinal movement of said second piston in response to movement of said mandrel in said first longitudinal direction relative to said housing;

a second shoulder formed on said mandrel and adapted for engaging and moving therewith said second piston in response to movement of said mandrel in response to movement of said mandrel in the second longitudinal directions relative to said housing and adapted to resist longitudinal movement in response to movement of said mandrel in said second longitudinal direction relative to said housing;

a second shoulder formed on said housing and adapted for engaging said first piston to resist longitudinal movement of said first piston in response to movement of said mandrel in said second longitudinal direction relative to said housing; and a fluid reservoir formed between said tubular housing and mandrel and adapted for receiving an operating fluid therein, said reservoir adapted for providing said operating fluid adjacent to said first and second pistons opposite said gas chamber, said first and second pistons having at least one seal to separate said gas chamber from said reservoir.

11. The accelerator of claim 10 wherein said second piston defines a restricted passage extending therethrough in fluid communication with said chamber and said reservoir.

12. The accelerator of claim 10 wherein said second piston defines a passage extending therethrough in fluid communication with said chamber and said reservoir, and a one-way pressure relief valve positioned in said second piston passage and adapted to permit fluid communication in a first direction of flow extending from said reservoir into said chamber.

13. The accelerator of claim 10 wherein said outer housing further comprises at least one external filler port.

14. The accelerator of claim 13 further comprising a fill hole operatively connecting said external filler port to said gas chamber.

15. The accelerator of claim 10 wherein said gas chamber contains nitrogen.

16. An accelerator for use with a jar mechanism comprising:

an inner mandrel and outer housing, said inner mandrel and outer housing each having shoulders;

first and second pistons defining the ends of a gas chamber disposed within a portion of said inner mandrel and outer housing, said shoulders of said inner mandrel and outer housing operably engageable with said first and second pistons to cause a pressure increase in said gas chamber and to cause a transfer of stored energy to said outer housing upon release of said jar mechanism;

a fluid reservoir formed between said tubular housing and mandrel and adapted for receiving an operating fluid therein, said reservoir adapted for providing said operating fluid adjacent to said first and second pistons opposite said gas chamber, said first and second pistons having at least one seal to separate said gas chamber from said reservoir, said second piston having a valve to allow said operating fluid to flow into said gas chamber;

said outer housing further having at least one external filler port; and a fill hole opened and closed with relative movement of said housing, said fill hole connected to a fill tube connecting said external filler port to said gas chamber.

17. The accelerator of claim 16 wherein said gas chamber contains nitrogen.

18. An accelerator for use in a downhole assembly comprising:

an inner mandrel disposed within a tubular outer housing;

upper and lower pistons forming a substantially sealed gas chamber between said inner mandrel and outer housing;

said inner mandrel further having shoulders to operatively engage and longitudinally move said upper and lower pistons thereby reducing the volume of said chamber and causing the pressure therein to increase;

said outer housing further having shoulders to operatively engage said upper and lower pistons upon the triggering of a drilling jar thereby translating stored energy into an upward or downward jarring force; a fluid reservoir formed between said tubular housing and mandrel and adapted for receiving an operating fluid therein, said reservoir adapted for providing said operating fluid adjacent to said first and second pistons opposite said gas chamber, said first and second pistons having at least one seal to separate said gas chamber from said reservoir; and a means for filling and discharging said gas chamber.

19. The accelerator of claim 18 wherein said means for filling and discharging said gas chamber further comprises a fill hole operatively connecting an external plug assembly in the outer housing to said gas chamber.

20. In an accelerator for use in a downhole assembly comprising an inner mandrel disposed within a tubular outer housing, and upper and lower pistons having at least one seal and forming a substantially sealed gas chamber between said inner mandrel and outer housing, a method of filling the gas chamber comprising the steps of:

unthreading sections of the outer housing of the accelerator until a passage to said gas chamber is created;

charging the gas chamber with gas through said passage to a predetermined pressure;

threading said sections of outer housing together, thereby causing said seal and said passage to said gas chamber to close.

21. In an accelerator for use in a downhole assembly comprising an inner mandrel disposed within a tubular outer housing, and upper and lower pistons having at least one seal and forming a substantially sealed gas chamber between said inner mandrel and outer housing, and a fill hole operatively connecting an external plug assembly in the outer housing to said gas chamber, a method of discharging the gas chamber comprising the steps of:

removing a filler plug from the external plug assembly;

installing an external filling adapter and valve to said external plug assembly;

closing said external valve;

unthreading sections of the outer housing of the accelerator until said seal opens a passage to said gas chamber; and opening said external valve to allow trapped gas to escape from the gas chamber and fill tube to an external source.

* * * * *